United States Patent [19]

Carr

[11] 4,345,654

[45] Aug. 24, 1982

[54] PNEUMATIC ATOMIZING FIRE FIGHTING SUPPLY TRUCK

[76] Inventor: Stephen C. Carr, 1245 E. 1300 South, Salt Lake City, Utah 84105

[21] Appl. No.: 194,054

[22] Filed: Oct. 6, 1980

[51] Int. Cl.[3] ..... A62C 27/18; A62C 27/28

[52] U.S. Cl. ..... 169/24; 169/13; 169/14; 239/132.5; 239/424

[58] Field of Search ..... 169/13–15, 169/24; 239/423, 424, 128, 132.5

[56] References Cited

U.S. PATENT DOCUMENTS

| | | | |
|---|---|---|---|
| 3,342,271 | 9/1967 | Anthony, Jr. | 239/343 X |
| 3,500,935 | 3/1970 | Wiedorn | 169/15 |
| 3,977,474 | 8/1976 | Boegli | 169/14 X |
| 4,007,793 | 2/1977 | Hux et al. | 169/25 |
| 4,037,664 | 7/1977 | Gibson | 169/24 X |
| 4,189,005 | 2/1980 | McLoughlin | 169/24 |

FOREIGN PATENT DOCUMENTS

| | | | |
|---|---|---|---|
| 733700 | 5/1980 | U.S.S.R. | 169/13 |

*Primary Examiner*—Charles A. Marmor
*Attorney, Agent, or Firm*—K. S. Cornaby

[57] ABSTRACT

A fire fighting supply system which is self-contained and provides regulated flows of air and water. The air atomizes the water upon passage through a plurality of atomizing nozzles. Atomized water droplets conveyed in a fog or mist provide a more effective fire extinguishing agent.

7 Claims, 4 Drawing Figures

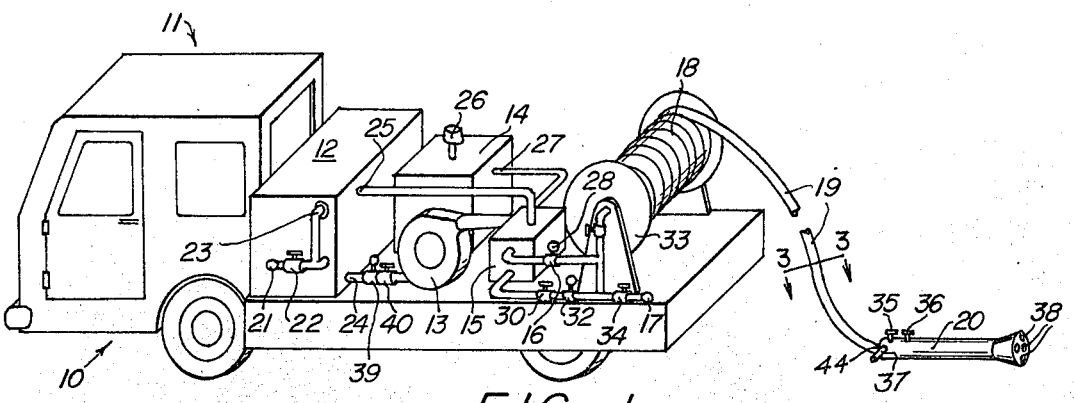
FIG. 1.
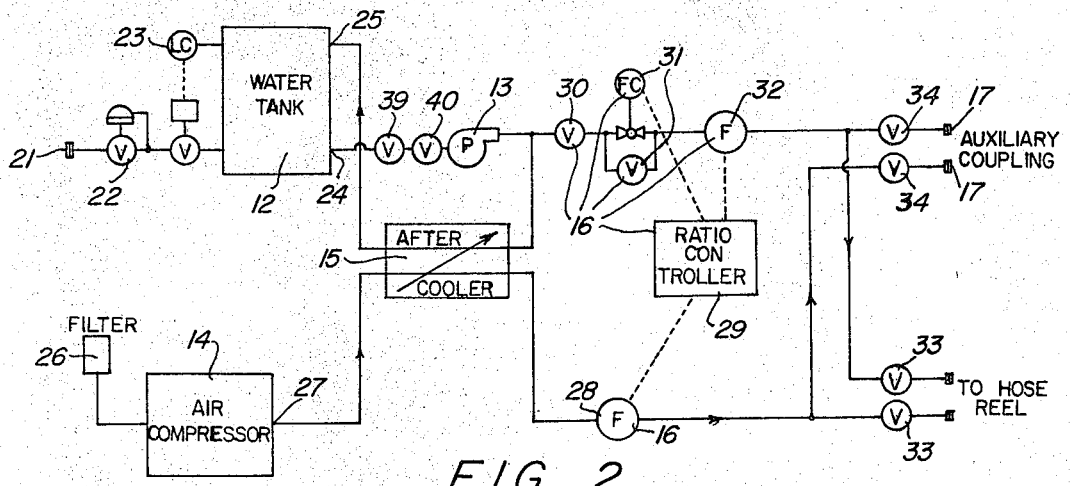
FIG. 2.
FIG. 3.
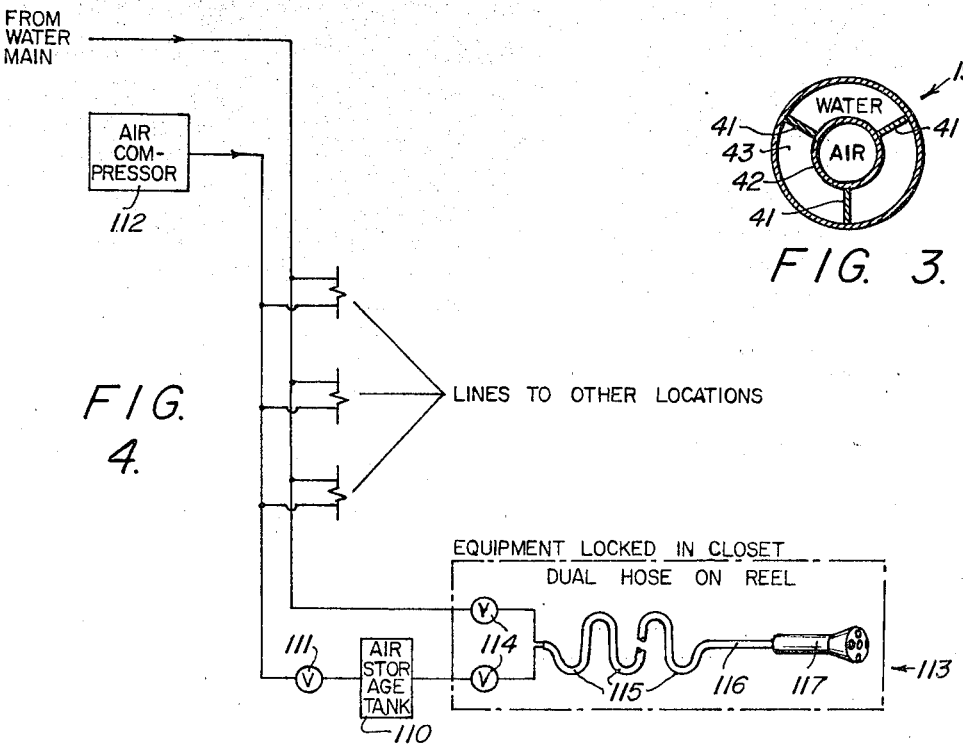
FIG. 4.

PNEUMATIC ATOMIZING FIRE FIGHTING SUPPLY TRUCK

BACKGROUND OF THE INVENTION

This invention relates to fire extinguishing equipment and specifically to a self-contained truck delivery system for fire fighting utilizing a method of pneumatic atomization.

Fire fighting systems have utilized numerous methods to extinguish fires. Economic waste caused by fire demands continuous improvement in fire fighting means. An effort to develop efficient and economical fire fighting has spawned extensive research and experimentation to improve techniques and equipment. Prior to the making of this invention, fire fighting systems ranged from bucket brigades to the application of sophisticated chemical agents, each having its own limitations. Many fires have raged unchecked because inefficient use of available water, and chemical fire retardants are expensive.

It is an objective of the present invention to minimize the problems recognized in the art by providing an efficient and economical mobile self-contained supply system for fire fighting which utilizes pneumatic atomization. Prior to the making of this invention, those skilled in the art believed that with pneumatic atomization the air used in atomizing the water would feed the fire. Such is not the case. The mass flow ratio of air to water required is very low so that the latent absorbtion of heat by the water applied far exceeds any additional combustion heat the atomizing air might allow to develop. A dense mist or fog of finely atomized water droplets extinguishes fire most effectively. Heat is removed rapidly as the droplets evaporate; the steam created blankets the combustion area and reduces the availability of oxygen; the mist is effectively opaque to infrared radiation allowing close approach to a fire; and, the atomized water droplets float in air and are easily carried into the fire with the combustion air.

SUMMARY OF THE INVENTION

The fire fighting supply system of the invention comprises a vehicle with an air compressor assembly, a water tank and pump assembly, a hose system, and an atomizing nozzle assembly. The vehicle is similar to the standard fire truck containing emergency warning devices and areas for storage of fire fighting equipment. The air compressor assembly comprises an air compressor, an inlet filter, a prime mover for the compressor, preferably the truck engine, a water operated aftercooler, a pressure regulating valve, and a level control valve; a water pump with an inlet check valve, a shutoff valve, and a prime mover for the pump; the aftercooler; and a flow regulating assembly comprising manual and automatic control valving and a transmitting flowmeter. The hose system comprises a live hose reel and a coaxial or parallel hose with a coupling device for separately conveying water and compressed air. The nozzle assembly comprises a hose coupling, a body casing with manual air and water shutoff valves, an air breathing mask coupling and a plurality of atomizing nozzles.

Operation of the invention conveys water from the water tank through the water pump. A certain amount of water is pumped through the aftercooler and returns to the water tank cooling the warm compressed air flowing from the air compressor. The remainder of the water passes through the flow controls into the hose and sprays from the nozzle assembly. Similarly, compressed air passes through the aftercooler and flow controls into the hose and atomizes the water upon leaving the nozzle assembly.

THE DRAWINGS

A preferred embodiment of the invention is illustrated in the accompanying drawings, in which:

FIG. 1 is a perspective view of a fire truck showing the substantial disposition of component parts of the fire fighting supply system;

FIG. 2 is a schematic diagram of the supply system;

FIG. 3 is a plan section along line 3—3 of FIG. 1 showing the design of a coaxial hose; and FIG. 4 is a schematic diagram of an alternative embodiment showing the supply system adapted for fire prevention within a building.

DETAILED DESCRIPTION OF THE ILLUSTRATED EMBODIMENTS

As shown in FIGS. 1 and 2, a preferred embodiment of the fire fighting supply system 10 has a truck 11 equipped substantially with a water tank 12, a water pump 13, an air compressor 14, an aftercooler 15, flow regulating devices 16, an auxiliary coupling 17, a live hose reel 18, a hose 19, and a nozzle assembly 20. The water tank 12 has a hydrant inlet connection 21, an inlet check valve 22, a level control valve 23, a water tank outlet 24 to the water pump 13, and a water tank inlet 25 from the aftercooler 15. The air compressor 14 has an inlet filter 26 and a compressor outlet 27. The flow regulating devices 16 comprise an air transmitting flowmeter 28, a ratio controller 29, a manual water control valve 30, an automatic water control valve 31, and a water flowmeter 32. The live hose reel 18 and the auxiliary coupling 17 have shutoff valves 33 and 34. The nozzle assembly 20 has manual air and water shutoff valves 35 and 36, an air breathing mask coupling 37, and atomizing nozzles 38.

The fire fighting supply system 10 operates to force water and air (or other gas) at regulated flows to the nozzle assembly 20 where the air atomizes the water upon passing through the atomizing nozzles 38. Water is drawn from the water tank 12, prefilled or hydrant connected, and travels through outlet 24, the inlet check valve 39, and shutoff valve 40 into the water pump 13. A portion of the water is pumped through the aftercooler 15 and back into the water tank 12. Circulation of water cools the warm compressed air as it proceeds through the aftercooler 15. The remaining water travels directly to the flow regulating devices 16 comprising the manual water control valve 30, the automatic water control valve 31, and the water flowmeter 32. The ratio controller 29 regulates the automatic flow through these devices 16 supplying water to the auxiliary coupling 17 and the hose reel 18. Air for the system is drawn through the air filter 26 by the air compressor 14 and released through outlet 27 into the aftercooler 15 where it is cooled. From the aftercooler 15, the compressed air proceeds through the air transmitting flowmeter 28 which regulates the air flow according to the dictates of the ratio controller 29. The regulated flow of air is delivered to the auxiliary coupling 17 and hose reel 18.

Air and water arriving at the hose reel 18 are channelled into the hose 19 through rotating unions on the reel shaft (not shown). As shown in FIG. 3, a hose 19 of coaxial design with centering ring spacers 41, air flow in the center tube 42, and water flow in the annular cavity 43 of said hose 19 is preferred for hose heat resistance. Such a design requires the center tube 42 to be reinforced against compressive collapse caused by superior water pressure. A hose 19 of coaxial design with air and water flows reversed or of parallel design may also be used. Thus, separate air and water supplies are delivered to the nozzle assembly 20 attached to the end of hose 19 by a coupling device 44. Each supply is channelled to the atomizing nozzles 38 where the atomizing process produces finely atomized water droplets which spray onto the fire. Several commercial pneumatic atomizing nozzles are available which would be suitable. Disposed upon the nozzle assembly 20 as shown in FIG. 1, are manual air and water shutoff valves 35 and 36 and an air breathing mask coupling 37.

The features described provide an efficient and economical fire fighting supply system. A most effective fire extinguishing mist is produced which uses less water and no complex chemical retardants.

Another embodiment, schematically illustrated in FIG. 4, provides that a large building may be furnished with fire fighting apparatus utilizing pneumatic atomization. Each floor or zone of a building would have an air tank 110 with shutoff valve 111 supplied by a single small compressor 112. Each air tank 110 would supply atomizing air to one or more extinguisher cabinets 113 comprising shutoff valving 114, a hose rack or reel 115, a hose 116, and an atomizing nozzle assembly 117. Water would be supplied from the building's water main.

A further embodiment utilizing pneumatic atomizing nozzles for fire suppression and extinguishment would be a vehicle equipped with air compressor, tank, and pump as previously described but having supported, cantilevered nozzles for fighting brush fires. Water supply for such a vehicle could be provided via an unbilical hose from a water supply truck following the vehicle.

Still another embodiment would be a portable back unit extinguisher constructed with a small compressed air cylinder and an air pressurized water tank.

It is to be understood that the particular form of the invention described herein and illustrated in the accompanying drawings are preferred embodiments. Various changes in shape, size, materials, and arrangement of parts may be made without departing from the spirit of the invention as defined in the attached claims.

I claim:

1. A fire fighting supply system utilizing pneumatic atomization for extinguishing fires, comprising in combination:

a vehicle having emergency warning devices and storage areas for fire fighting equipment;

a water tank and pump assembly for supplying and pumping water to an aftercooler, and a hose and nozzle assembly;

an air compressor for supplying a pressurized flow of air to the hose and nozzle assembly;

said water operated aftercooler disposed to cool warm compressed air from said air compressor;

manual and automatic ratio flow regulating devices;

said hose and nozzle assembly comprising a live hose reel, a hose, and a nozzle apparatus with a plurality of pneumatic atomizing nozzles.

2. A fire fighting supply system as set forth in claim 1, wherein said system has an auxiliary coupling for an additional hose.

3. A fire fighting supply system as set forth in claim 1, wherein said water tank has a hydrant connection coupling.

4. A fire fighting supply system as set forth in claim 1, wherein said hose is coaxial with centering ring spacers and a reinforced center tube such that the water and air flows are maintained separate until atomization.

5. A fire fighting supply system as set forth in claim 1, wherein said hose is of parallel design such that the water and air flows are maintained separate until atomization.

6. A fire fighting supply system as set forth in claim 1, wherein manual shutoff valves are disposed such that control of air and water flow may be manually maintained to said water tank, water pump, hose reel, and hose and nozzle assembly.

7. A fire fighting supply system as set forth in claim 1, wherein said nozzle assembly has an air breathing mask coupling connected with the air supply.

* * * * *